US005781959A

United States Patent [19]

Tipotsch

[11] Patent Number: 5,781,959

[45] Date of Patent: Jul. 21, 1998

[54] MOLDED PLASTIC MOP WRINGER

[76] Inventor: Donald G. Tipotsch, 329 S. Rockford Dr., Tempe, Ariz. 85281-3053

[21] Appl. No.: 647,557

[22] Filed: May 14, 1996

[51] Int. Cl.[6] ..... A47L 13/58

[52] U.S. Cl. ..... 15/263

[58] Field of Search ..... 15/260, 263

[56] References Cited

U.S. PATENT DOCUMENTS

| | | | |
|---|---|---|---|
| 385,601 | 7/1888 | Ennes | 15/263 |
| 943,650 | 12/1909 | Callis et al. | 15/263 |
| 981,448 | 1/1911 | Matthews . | |
| 2,149,255 | 3/1939 | Faber | 15/263 |
| 2,508,947 | 5/1950 | Hoke | 15/263 X |
| 2,567,708 | 9/1951 | Heber | 15/263 |

FOREIGN PATENT DOCUMENTS

| | | | |
|---|---|---|---|
| 126473 | 1/1948 | Australia | 15/263 |
| 480581 | 1/1952 | Canada | 15/263 |
| 516040 | 8/1955 | Canada | 15/263 |
| 755605 | 9/1933 | France | 15/263 |
| 603403 | 6/1948 | United Kingdom | 15/263 |
| 1125507 | 8/1968 | United Kingdom | 15/263 |

*Primary Examiner*—Mark Spisich

[57] ABSTRACT

A molded plastic conical mop wringer that incorporates a clip and supporting ribs to firmly support the wringer in a stable position below the rim of the pail. The openings in the conical surface are elliptical and do an excellent job of gripping the ends of the mop strands as the mop is twisted and pressed to eliminate the liquid.

3 Claims, 1 Drawing Sheet

MOLDED PLASTIC MOP WRINGER

BACKGROUND

Historically mop wringers of the conical type were made of sheet metal or metal stampings; with clips spotwelded, wire formed, or screwed to the wringer body to support the wringer in the pail.

Numerous methods were used to grip the mop strands, including distorted cones with round holes, or long slots vertically oriented around the cone.

In general these wringers were mounted with the top rim of the conical body even with or above the rim of the pail. In some cases the wringer rim was mounted at an acute angle with the rim of the pail so the overflow would run into the pail.

SUMMARY AND OBJECTS OF THE INVENTION

An object of the invention is to make a conical mop wringer of a material that can be mass produced without secondary operations for corrosion resistance and aesthetics and yet is strong enough to withstand the twisting and pressing required to remove the liquid in the strands.

Another object of the invention is to provide openings in the conical body that will efficiently allow entrance and grip the mop strands so the mop can be twisted to eliminate the liquid, in addition provide openings for the liquid return to the pail.

A further object of the invention is to include an integral clip and supporting ribs to rigidly mount the rim of the conical wringer below and approximately parallel with the rim of the pail in order that the overflow liquid will return to the pail.

DETAILED DESCRIPTION OF INVENTION

Figure 1:
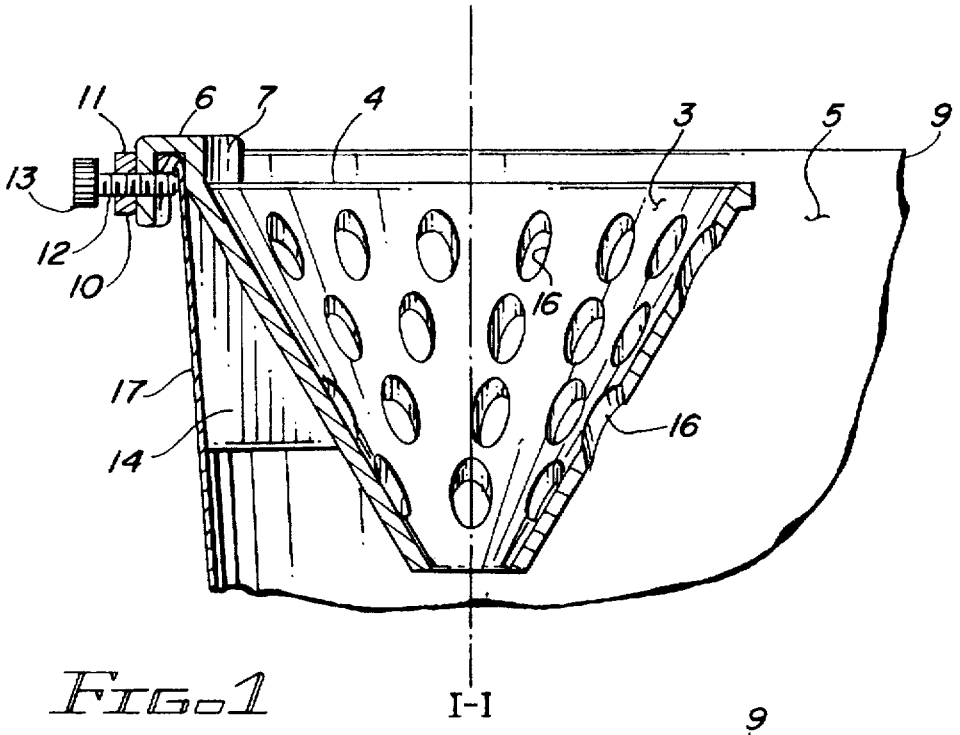
FIG. 1 is an elevation cross section of the wringer, thru the center of the mounting clip, attached to a fragmented section of a pail.
Figure 2:
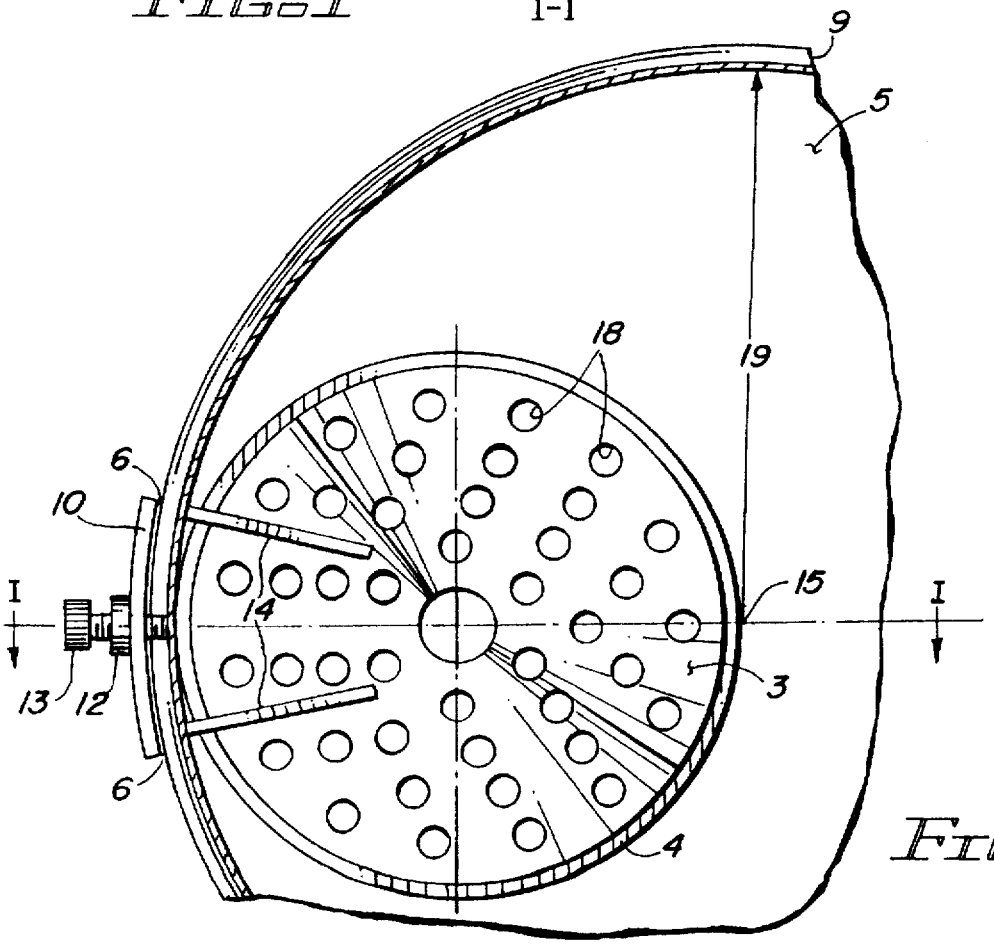
FIG. 2 is a bottom plan view of the wringer looking thru a fragmented section of a pail.

Referring to FIGS. 1 and 2, Item 3 is the wringer with it's rim 4 mounted substantially below the rim 9 of the pail 5 by a clip 6. The wringer body 3 is a truncated cone with the large diameter at the top, for mop insertion, and the smaller diameter at the bottom for drainage. The wall of the cone 3 has a plurality of openings 18 arranged in a uniform pattern, and are produced by penetrating cylinders with axis parallel to the axis of the cone.

These vertically oriented ellipses grip the mop strands when the mop is twisted and pressed, as well as allowing the liquid to drain and return to the pail. In addition the surfaces 16 produced by the projected cylinders are circular in cross section thus retaining maximum strength without sharp cornered stress concentraters.

The clip 6 is a wide integrally molded unit that protrudes upward at 7 from the rim 4 of the wringer 3 outward over the rim 9 of the pail 5 and downward at 10 over the rim or bead 9 of the pail 5. The downward portion 10 of the clip, has boss 11, and tapped hole 12, for a thumb screw 13 that engages the bead 9 of the pail 5. This prevents the wringer 3 from lifting when the mop is removed, and supports the rim 4 of the wringer 3 well below the rim 9 of the pail, which allows all overflow to return to the pail.

The supporting ribs 14 are an integral part of the molded wringer. The ribs 14 extend downward along the cone and radiate from the outer edge of the clip 6, to the pail center 15. The outer engaging edge 17 of the ribs 14 have a taper equivalent to the average pail 5 taper, thus when the wringer 3 is mounted in the pail 5, the rim 4 of the wringer 3 is substantially parallel to the rim of the pail 9.

Since the ribs 14 radiate towards the pail center, the preferred pail radius 19 would equal the wringer 3 diameter, the ribs edge 17 being tangent to the inner radius of the pail 5, thus providing a rigid mount for the wringer.

I claim:

1. A mop wringer comprising:

(a) a molded plastic body having a conical shape, said body having a first open end at a top portion thereof and a second open end at a bottom portion thereof, said second open end being smaller in size than said first open end, said body further having a central axis of symmetry;

(b) a plurality of perforations extending through said body, said perforations each having a cylindrical peripheral wall disposed about a perforation axis, each perforation axis being oriented parallel to the central axis of symmetry of said body, whereby said perforations have an elliptical appearance when the body is viewed from above; and (c) wherein the perforations are adapted to grip strands of a mop when the mop is twisted and pressed and further wherein they also permit any liquid present in the mop to drain.

2. A mop wringer as set forth in claim 1 further comprising a clip on said body for supporting said body on a rim of a pail.

3. A mop wringer as set forth in claim 2 further comprising ribs attached to an external surface of said body and extending from adjacent the top portion to adjacent the bottom portion thereof, the width of each rib increasing toward said bottom portion of the body and wherein each rib includes an edge adapted to engage an inner wall of the pail, whereby the wringer is solidly supported within said pail during use.

* * * * *